United States Patent [19]

Holmes

[11] Patent Number: 4,541,528

[45] Date of Patent: Sep. 17, 1985

[54] HINGED COIN HOLDER

[75] Inventor: Gordon W. Holmes, Mississauga, Canada

[73] Assignee: Professional Packaging Limited, Mississauga, Canada

[21] Appl. No.: 600,985

[22] Filed: Apr. 16, 1984

[30] Foreign Application Priority Data

Apr. 5, 1983 [CA] Canada ..... 425138

[51] Int. Cl.[4] ..... B65D 85/62; B65D 8/04; B65D 25/54; A45C 11/00

[52] U.S. Cl. ..... 206/0.82; 206/445; 206/0.83; 220/20; 220/339

[58] Field of Search ..... 206/0.82, 0.83, 0.84, 206/445, 459; 220/10, 339

[56] References Cited

U.S. PATENT DOCUMENTS

| | | | |
|---|---|---|---|
| 2,221,072 | 11/1940 | Bennett | 206/0.84 |
| 4,139,093 | 2/1979 | Holmes | 206/0.82 |
| 4,290,523 | 9/1981 | Wallace | 220/339 |

*Primary Examiner*—William T. Dixson, Jr.
*Attorney, Agent, or Firm*—Sim & McBurney

[57] ABSTRACT

A hinged coin holder having two semi-circular parts hinged together at one curvilinear extremity and releasably joined at the other is improved by the provision of a plurality of internal pockets or compartments which are dimensioned to receive no greater than a predetermined number of coins of a specific denomination, irrespective of the thickness of the coins, so that the maximum desired number of coins may be unerringly packaged in the holder.

13 Claims, 5 Drawing Figures

HINGED COIN HOLDER

FIELD OF INVENTION

The present invention relates to holders for disc-like objects, such as coins, tokens and the like.

BACKGROUND OF THE INVENTION

In the handling, distribution and banking of coins, coins are packaged according to specific established numbers, depending on the denomination of the coins. The most common means of packaging the coins is a paper wrapper which is applied around a cylinder of the coins by hand or by automatic machine, the ends of the wrapper being folded over to retain the coins in place. Spiral-wound paper tubes also are used and provide a more rigid carrier although the open ends of the tube require to be crimped or beaded to retain the coins in place. Since the package provided in this manner is opaque, external printing is required to identify the contents.

This prior art packaging procedure suffers from many disadvantages which are currently tolerated by some financial institutions for lack of viable and inexpensive alternative.

It is customary for the larger financial institutions to wrap coins automatically with the traditional numbers of coins and distribute the roll packages to retailers and other coin users. Retailers usually check the count of the coins upon opening the roll to ensure the correct number is present. Discrepancies of one or more coins short or over are often found as a result of the ability of the paper wrapper readily to adjust to incorrect numbers of coins and the only recourse is to double check the numbers, a time consuming and tedious operation. Further, when the paper tube type package is used, it is not uncommon for the tube to be disposed of with a coin or coins still positioned in the tube, the lack of detection of this coin arising from its light weight character.

Dexterity and skill are required to wrap coins manually in the paper wrappers and many people find it impossible or extremely difficult to form the wrapped cylinders of coins. This is especially true of older persons and young people. When coins are not properly wrapped and ends sealed, coins can fall out, leading to considerable aggravation, and time and material wastage.

Hand counted coin packages often have improper numbers especially where higher number of coins are involved, leading to the necessity for a bank receiving such rolls to double check the numbers before crediting the customer.

Further, due to the opaque nature of the rolls and hence the lack of ability to visually observe the contents without breaking open the roll, there is a considerable opportunity to substitute worthless slugs, cheaper coins or foreign coins in a roll of coins, which, if undetected, leads to an appropriate loss for the bank or other recipient.

The rolls of coins, especially in the form of paper wrapped rolls, are not resistant to rough handling and hence there is a tendency for such rolls to split open or to become unrolled when bags containing them are dropped or roughly handled, leading to the necessity of counting and wrapping the coins anew.

The cylindrical nature of the coin rolls allows them to roll readily on surfaces on which they are positioned, for example, a table, and such rolling may result in the rolls falling onto the floor and breaking open, with consequent problems of collection and reassembly.

When the roll packages are opened to remove the coins therefrom, it is usual to split open the roll in the middle or some other location along its length and then throw the wrapper away. Such wrappers thus are usually used only once.

In our Canadian Pat. No. 1,075,177 there is described a unique reusable coin holder which overcomes all the prior art problems attendant the paper wrappers. The coin holder is constructed of flexible polymeric material, such as, polypropylene, and consists of a hollow elongate cylindrical body having a generally circular cross section of diameter substantially that of the disc-like objects and integral annular end walls which define circular openings at the ends of the body having a diameter less than the diameter of the disc-like objects. The elongate cylindrical body is formed of two semi-circularly cross-sectioned portions hingedly joined together at one common edge by a continuous longitudinal hinge and releasably joined together at the other common edge to enable opening of the body to occur at the other common edge and hinging of the two portions relative to each other to occur along the continuous hinge to gain access to the interior of the body. The coin holder of this prior art patent is formed by molding as an integral element and is capable of being manually or machine loaded with coins, tokens or other disc-like objects.

Recently the Royal Canadian Mint has begun to issue coins which are of lesser weight and slightly thinner than those already in circulation, so that there exist two different thicknesses of coins for the one penny denomination and possibly other denominations in the future. Variations in coin thickness within one denomination also arise from wear during use and lack of quality control in the original minting and such variations have been observed in the coinage of a number of countries.

The difference in thickness makes it difficult to ensure that, for example, exactly 50 one cent pieces are present in a coin holder intended to hold that number, since a lesser or higher proportion of the thinner coins may result in the provision of space for one, two, three or even more coins additional to the desired coin count.

This possibility adversely affects one of the advantages of the prior art coin holder, namely the absence of necessity to check for the correctness of the number of coins in the holder, although it does not destroy its overall utility as a holder for coins and other disc-like objects, especially when the exact number of items packaged is not critical.

SUMMARY OF INVENTION

In accordance with the present invention, this problem of our prior art coin holder is overcome by subdividing the interior of the coin holder into a plurality of individual coin-receiving pockets which are longitudinally dimensioned to receive a maximum of no more than a predetermined number of coins, irrespective of whether the coins are made up of all traditional thickness coins, all newer thinner coins or a mixture of thicknesses of coins. In this way, the presence of the correct number of coins in the coin holder is always assured.

The plurality of individual coin-receiving pockets may be provided in any convenient manner such as by the provision of a plurality of generally C-shaped parallel ribs located in one half only of the hinged body and equidistantly longitudinally spaced apart from each other. The number of such ribs, and consequently the number of pockets, depends on the total number of coins to be packaged in the coin holder and the number to be received in each pocket. Such ribs are integrally-formed with the body half, so that the whole coin holder is formed as an integral part by injection molding.

DESCRIPTION OF PREFERRED EMBODIMENTS

Figure 1:
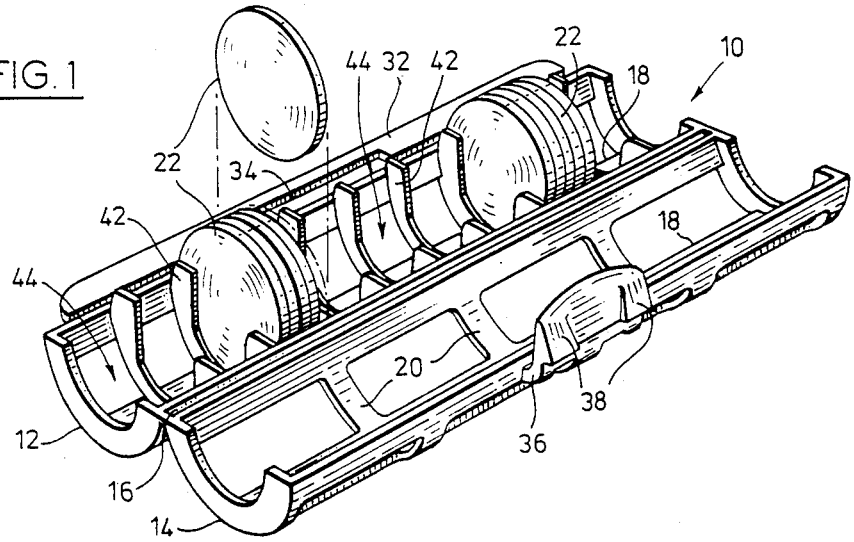
FIG. 1 is a perspective view from above of a coin holder constructed in accordance with one embodiment of the invention in the open position.

Referring now to the drawings, a hollow cylindrical coin holder 10 comprises two semi-circular halves 12 and 14 hingedly joined together through a living hinge 16 formed at one common edge thereof and extending continuously along a common longitudinal edge of the two body halves 12 and 14.

Each body half 12 and 14 has a rectangular bar 18, extending from one longitudinal end of the respective body half to the other. The rectangular bar 18 on each body half 12 and 14 is located approximately half-way between the curvilinear extremities of the body half 12 or 14. The rectangular bar 18 is recessed to highlight printing or other indicia molded thereon. A plurality of arcuate ribs 20 is provided extending between the curvilinear extremities of each body half 12 and 14 to define with the rectangular bar 18 an open framework through which coins 22 can be viewed.

Each longitudinal end of the coin holder 10 has a circular opening 24 of diameter less than the diameter of the coins 22, to prevent coins from falling out of the holder through the end opening 24. The circular opening 24 is defined by annular end walls 26 which are made up of end wall portions 28 and 30 integral with the coin holder body halves 12 and 14 respectively.

A single elongate upstanding flange 32 is provided at the curvilinear extremity of the body half 12 and an elongate slot 34 is formed at about the midpoint along the length of the flange 32. The holder 10 is formed so that the plane in which lies the flange 32 bisects the living hinge 16. At the curvilinear extremity of the other body half 14 is formed a resiliently flexible tongue member 36 which curves away from the curvilinear extremity and then extends generally tangentially with respect to the body half 14. The flexible tongue member 36 has a lateral dimension that is slightly less than the length of the slot 34 to allow passage of the tongue member 36 therethrough. A pair of wedge-shaped projections 38 is formed at the extremity of the tongue member 36 remote from the curvilinear extremity of the body half 14.

Figure 3:
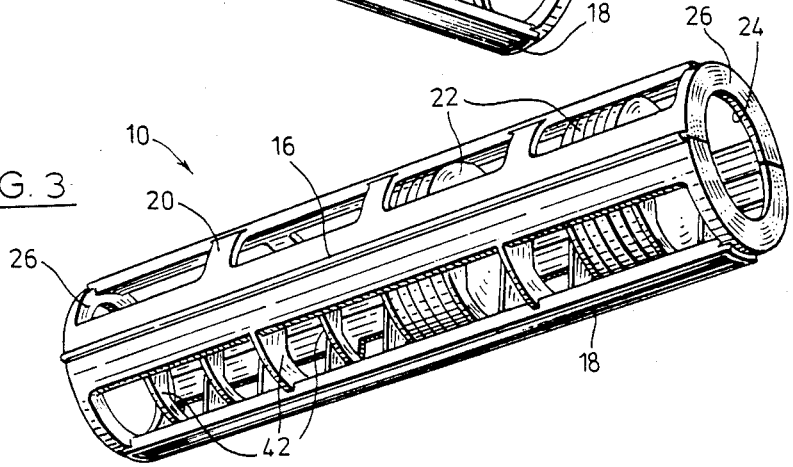
FIG. 3 is a perspective view of the coin holder of FIG. 1 in the closed position.
Figure 4:
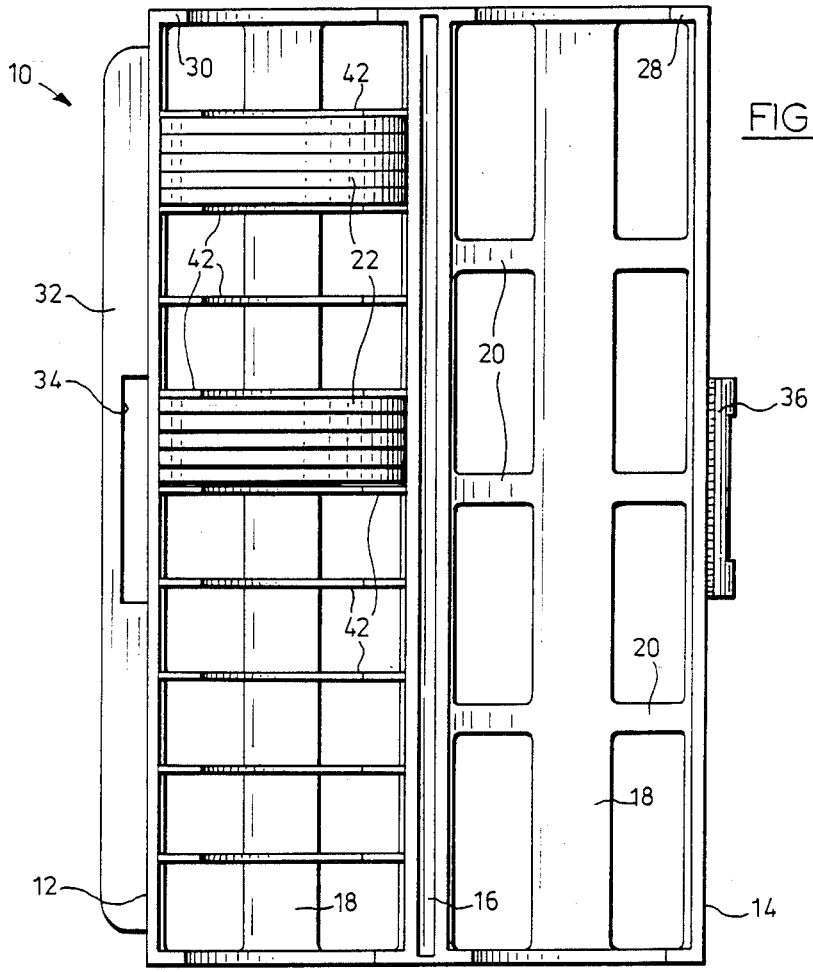
FIG. 4 is a plan view of the coin holder of FIG. 1 in the open position.

As the tongue member 36 is received in the slot 34, the tongue member 36 is caused to flex downwardly as the upper surface of the slot 34 rides up the projection 38 until the projections 38 clear the rearward edge of the slot 34, at which point the tongue member 36 snaps upward, so that interference between the rear faces of the projections 38 and the adjacent face of the flange 32 connect together the two body halves 12 and 14 and retains the holder in its closed position as illustrated in FIG. 3. The tongue member 36 is dimensioned so that the projections 38 clear the rear edge of the slot 34 just as the two body halves 12 and 14 close, so that the coin holder 10 snugly encloses coins positioned therein.

The holder 10 is opened by pressing down on the tongue member 36 until the projections 38 clear the top edge of the slot 34 and can be withdrawn through the slot 34. The living hinge 20 may have a built-in spring action to urge the body halves 12 and 14 partly apart. Ribs 40 are positioned on opposite sides of the slot 32 to prevent accidental depression of the tongue member 36 when the coin holder 10 is closed and thereby prevent accidental opening of the coin holder 10.

In accordance with the present invention, a plurality of generally C-shaped laterally-thin ribs 42 are located in the one body half 12 defining a plurality of separate coin-receiving pockets 44. The ribs 42 are parallel to each other and equally longitudinally spaced apart, so as to provide a plurality of coin-receiving pockets 44 of the same longitudinal dimension. In the illustrated embodiment, there are ten pockets 44 but this number may be varied depending on the number of coins to be packaged in the holder and the number of coins desired in each pocket 44.

The coin-receiving pockets are dimensioned to receive a maximum number of coins irrespective of the thickness of the coins. In the illustrated embodiment, a maximum of five pennies (one cent pieces) is intended to be received in each pocket 44. As shown, in one pocket 44 five coins completely fill the longitudinal length while in another pocket 44, the five coins do not completely fill the longitudinal length but the remaining space available is insufficient to permit a further coin to be inserted in that pocket 44.

By dimensioning the pockets 44 in this way, no more than five pennies can be accommodated therein, irrespective of the individual thickness of the pennies. If all the pennies are of the older thicker dimension, then they will occupy all the longitudinal dimension of the pocket 44 while if all the pennies are of the newer thinner dimension, then they will occupy a substantial proportion but not all of the longitudinal dimension of the pocket 44, with the remaining gap being insufficient to permit an additional penny of thinner or thicker dimension to be positioned therein. The correct number of coins, therefore, always are packaged in the coin holder 10 and it is not possible accidentally to have more coins than the correct maximum number intended to be packaged in the coin holder, thereby avoiding the necessity to count the number of coins and overcoming the aforementioned problem of the coin holder of our Canadian Pat. No. 1,075,177.

Figure 2:
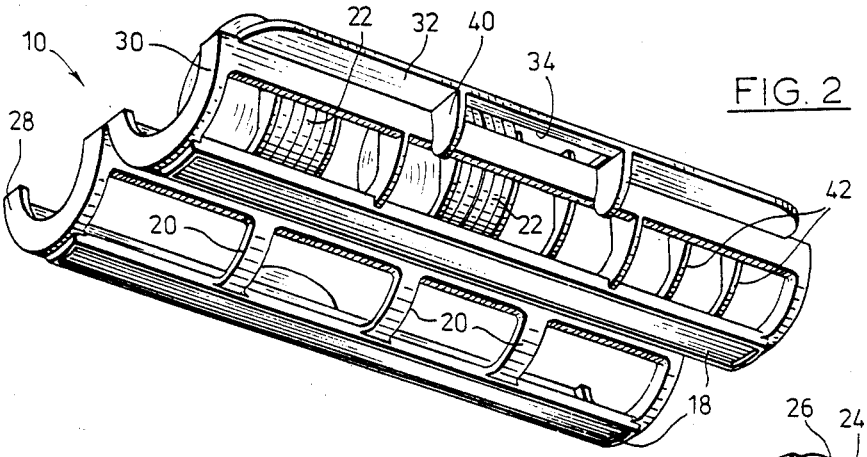
FIG. 2 is a perspective view from below of the coin holder of FIG. 1.
Figure 5:
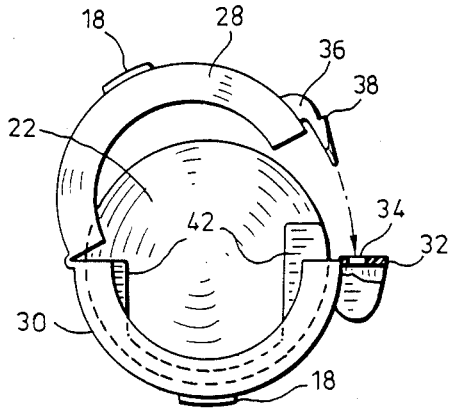
FIG. 5 is an end view of the coin holder of FIG. 1.

As may be seen most clearly in FIGS. 1, 2 and 5, the ribs 42 extend beyond the curvilinear extremity of the body half 12 for a short distance to assist in strengthening and stabilizing the overall structure when closed by engagement between the ribs 42 and the underside of the body half 14.

While the structure of the illustrated embodiment has been described with reference to the flange 32 and associated slot 34 being integrally-formed with the curvilinear extremity of the body half 12 and the tongue member 36 being integrally-formed with the curvilinear extremity of the body half 14, the locations of the flange 32 and tongue member 36 may be reversed, if desired.

The coin holder 10 is constructed of any suitable polymeric material, such as, polypropylene, and may be readily formed by injection molding as a single piece.

The coin holder 10 may be partially filled with coins, if desired, by inserting coins 22 in one or more of the pockets 44 and one or more coins may be added to the holder 10 from time to time, which is not possible with conventional paper wrappers. This feature allows the coin holder 10 to be used as a savings bank for coins over a period of time, until the coin holder 10 has been completely filled up with coins to the maximum capacity of the holder, ready for bank deposit.

The coin holder 10, therefore, may replace loose saving of coins in a receptacle, such as a piggy bank, and eliminates the necessity to sort and count such coins prior to their bank deposit.

A number of such coin holders 10 may be provided for different denomination coins in a storage device, so that saved coins are sorted and stored in a single convenient device. The holders 10 are constructed to receive only the exact number of coins of the particular denomination. Even allowing for marginally different thickness of coins due to wear and the different thickness of coins in circulation as a result of the recent introduction of thinner coins in penny denomination, the holder 10 is incapable of packaging more coins than intended as a result of the provision of the plurality of pockets 44. The prior art problems associated with incorrect numbers being packaged in paper wrappers and plastic coin holders are thus overcome.

The coin holder 10 may be colour-keyed for different denominations and/or numbers, to assist in facilitating counting and sorting of large shipments of stocks of coinage and to avoid confusion between coins of a similar size.

The holder 10 is rugged and capable of reuse many times before it become unsuitable for continued use. This contrasts markedly with the one-time use of paper wrappers.

The ready opening of the holder 10 into two convenient halves and the simple closure operation allows easy filling of the holder 10 without the manual dexterity required with the conventional paper wrappers. The open nature of the body of the holder 10 allows ready detection of slugs, foreign coins or improperly sized coins in the holder 10, and the consequent losses and possibilities for fraudulent practices prevalent with the prior art are avoided.

The exterior surface of the holder 10 may be provided with identifying information, for example, the number and denomination of the coins, total value of the coins and bank or other source identification. Suitable locations for such information are the longitudinal ribs 18.

SUMMARY OF THE DISCLOSURE

In summary of this disclosure, the present invention provides a plastic coin holder of unique design which is superior to conventional coin packaging operations and other hinged coin holders in permitting only the desired number of coins to be packaged therein. Modifications are possible within the scope of the invention.

What I claim is:

1. A holder for disc-like objects constructed of polymeric material and formed by molding as an integral element, comprising:

an elongate hollow cylindrical body having a generally circular cross-section of diameter substantially that of the disc-like objects to be packaged therein and formed of two semi-circularly cross-sectioned portions hingedly joined together at one common edge and releasably joined together at the other common edge to enable opening of said body to occur at the other common edge and hinging of the two portions relative to each other to occur at the one common edge to gain access to the interior of the body, and means defining a plurality of separate object-receiving pockets within the hollow body and each of which is dimensioned to receive no more than a predetermined maximum number of said objects.

2. The holder of claim 1 wherein each said object-receiving pocket is defined by a plurality of parallel ribs equidistantly spaced apart within the body to define with end walls a plurality of equally-dimensioned pockets.

3. The holder of claim 2 wherein said end walls comprise annular end walls which define circular openings at the ends of the body having a diameter less than the diameter of the disc-like objects and having the same centre of curvature as that of the body, said annular end walls being formed of two parts, one integral with each of said body portions.

4. The holder of claim 3 wherein said ribs are formed in one only of said body portions and are of generally C-shaped cross section extending between the curvilinear extremities of the one body portion.

5. The holder of claim 1 wherein said releasable join is provided by the interaction of at least one wedge-shaped upwardly-extending projection provided at and tapering towards the arcuate extremity of a resiliently flexible tongue extending from adjacent the midpoint along the length of one curvilinear extremity of the body and a slot having a length slightly greater than the transverse dimension of the tongue and formed in an upright flange extending from the other curvilinear extremity of the body in a plane which passes through the body hinge line, the slot receiving the tongue therethrough so that engagement between the rear edge of the wedge-shaped projection and the adjacent surface of the flange prevents withdrawal of the tongue through the slot and opening of the holder until the tongue is depressed so that the rear edge is free from the flange.

6. The holder of claim 5 wherein said at least one wedge-shaped projection is constituted by a pair of laterally-spaced wedge-shaped projections formed on said tongue.

7. The holder of claim 5 wherein said body has annular end walls which define circular openings at the ends of the body having a diameter less than the diameter of the disc-like objects and having the same centre of curvature as that of the body, said annular end walls being formed of two parts, one integral with each of said body portions; and said object-receiving pockets are defined by a plurality of parallel ribs formed in the body portion having said flange at its curvilinear extremity, said ribs being of generally C-shaped cross-section and extending between the curvilinear extremities of the one body portion and extend for an additional curvilinear distance to underlie the other body portion adjacent said flange member when closed and during opening and closure.

8. The holder of claim 1 wherein said body has an open framework defined by longitudinally-extending ribs and arcuately-extending ribs to permit viewing of the contents of the holder without opening the same.

9. The holder of claim 8 wherein said longitudinally-extending ribs are constituted by two parallel elongate bars, each located midway between the curvilinear extremities of one of the body portions.

10. The holder of claim 9 wherein each said bar has a recessed surface.

11. The holder of claim 5 including upstanding ribs formed adjacent the opposite longitudinal ends of the slot to prevent accidental dislodgement of said tongue and opening of the holder.

12. The holder of claim 6 including upstanding ribs formed adjacent the opposite longitudinal ends of the slot to prevent accidental dislodgement of said tongue and opening of the holder.

13. The holder of claim 7 including upstanding ribs formed adjacent the opposite longitudinal ends of the slot to prevent accidental dislodgement of said tongue and opening of the holder.

* * * * *